US006470817B2

(12) United States Patent
Delfosse

(10) Patent No.: US 6,470,817 B2
(45) Date of Patent: Oct. 29, 2002

(54) SMALL WATERPLANE AREA MULTIHULL (SWAMH) VESSEL

(76) Inventor: Barry E. Delfosse, 4140 Workman Mill Rd. #18, Whittier, CA (US) 90601

( * ) Notice: Subject to any disclaimer, the term of this patent is extended or adjusted under 35 U.S.C. 154(b) by 0 days.

(21) Appl. No.: 09/825,832

(22) Filed: Apr. 5, 2001

(65) Prior Publication Data

US 2001/0014564 A1 Aug. 16, 2001

Related U.S. Application Data

(63) Continuation-in-part of application No. 09/259,586, filed on Mar. 1, 1999.

(51) Int. Cl.[7] ..... B63B 1/00

(52) U.S. Cl. ..... 114/61.14; 114/61.1; 114/280; 440/38

(58) Field of Search ..... 440/38, 46, 47, 440/48, 62, 6, 49; 114/20.1, 61.1, 61.12–61.19, 278, 280, 281, 282, 283; 60/221, 222

(56) References Cited

U.S. PATENT DOCUMENTS

| | | | | | |
|---|---|---|---|---|---|
| 2,381,622 | A | * | 8/1945 | Sheppard | 440/48 |
| 2,530,718 | A | * | 11/1950 | Napoli | 114/61.29 |
| 2,941,495 | A | | 6/1960 | Goldman | |
| 3,055,331 | A | | 9/1962 | Singelmann | |
| 3,338,203 | A | | 8/1967 | Moore | |
| 3,811,141 | A | | 5/1974 | Stoeberl | |
| 3,811,398 | A | * | 5/1974 | Burgin | 440/38 |
| 3,842,772 | A | | 10/1974 | Lang | |
| 3,848,558 | A | * | 11/1974 | Henry | 114/313 |
| 3,911,190 | A | | 10/1975 | Myers et al. | |
| 4,094,027 | A | | 6/1978 | Vernon | |
| 4,118,814 | A | | 10/1978 | Holtom | |
| 4,254,729 | A | * | 3/1981 | Muller | 114/280 |
| 4,343,611 | A | * | 8/1982 | Scott-Scott | 440/45 |
| 4,389,197 | A | * | 6/1983 | Ballantine | 440/38 |
| 4,505,684 | A | | 3/1985 | Holden et al. | |
| 4,557,211 | A | | 12/1985 | Schmidt | |
| 4,802,427 | A | | 2/1989 | Nickell, Jr. | |
| 4,838,819 | A | | 6/1989 | Todorovic | |
| 4,936,237 | A | * | 6/1990 | Walters | 114/61.1 |
| 4,953,492 | A | * | 9/1990 | Duffty | 114/282 |
| 5,178,085 | A | | 1/1993 | Hsu | |
| 5,181,868 | A | | 1/1993 | Gabriel | |
| 5,184,561 | A | | 2/1993 | Nickell, Jr. | |
| 5,265,549 | A | * | 11/1993 | Cernier | 114/61.1 |
| 5,313,906 | A | | 5/1994 | Zapka | |
| 5,344,345 | A | * | 9/1994 | Nagata | 440/44 |
| 5,435,763 | A | | 7/1995 | Pignata | |
| 5,613,460 | A | | 3/1997 | Stallard | |
| 5,722,864 | A | | 3/1998 | Andiarena | |
| 5,722,866 | A | | 3/1998 | Brandt | |
| 6,152,791 | A | * | 11/2000 | Sinko et al. | 440/6 |
| 6,213,042 | B1 | * | 4/2001 | Delfosse | 114/61.1 |

* cited by examiner

*Primary Examiner*—S. Joseph Morano
*Assistant Examiner*—Ajay Vasudeva
(74) *Attorney, Agent, or Firm*—Peter A. Bursari

(57) ABSTRACT

A Small Waterplane Area MultiHull vessel having an upper hull platform located above the design water line of the vessel which is maintained above the surface of a body of water by at least two cylindrical submerged hulls joined thereto by supporting struts. A buoyant core material is contained between inner and outer walls of the submerged hulls which define a cylindrical space in which a rotary propulsive means may be housed. In one embodiment, an engine means is situated on the upper hull platform and is joined to the rotary propulsive means through a work translating means which converts the output of the engine to rotary motion of the rotary propulsive means to provide a propulsive force.

15 Claims, 9 Drawing Sheets

SMALL WATERPLANE AREA MULTIHULL (SWAMH) VESSEL

RELATED APPLICATIONS

This application is a continuation-in-part of U.S. patent application Ser. No. 09/259,586, filed Mar. 1, 1999.

FIELD OF INVENTION

The present invention relates to additional improvements in small waterplane area multihull (SWAMH) vessels. Specifically, the present invention provides a multihull vessel having an upper hull platform which is maintained above the surface of a body of water by at least two submerged hulls joined thereto by supporting struts. The submerged hulls are filled with a buoyant core material and each are capable of housing a rotary propulsive means. The surface platform is capable of holding an engine means which will drive the rotary propulsive means.

BACKGROUND OF THE INVENTION

Small waterplane area multihull (SWAMH) vessels are multihull vessels comprising at least two submerged hulls which are connected to a work platform or upper hull that resides above the water. Connections are made by elongated struts which have a cross-sectional profile substantially smaller than that of the submerged hulls. Constructed in this manner, the vessel through water presents a platform or hull which is relatively insensitive to water surface disturbances; however, large propulsive forces are required to impel a SWAMH vessel due to combined effects of frictional resistance of the large wetted surface of the hulls and interference resistance occurring as an interaction between the twin hulls. Numerous attempts have been made to improve the performance of watercraft in general and of SWAMH vessels in particular, whether to improve the buoyancy, durability or handling capabilities of a vessel or to improve the performance characteristics of passive motivating means such as sails or active motivating means such as engines or oars.

Attempts have been made in the prior art to improve both buoyancy and performance have included using multiple hulls and double walled hulls having a buoyant material entrained therebetween. For example, U.S. Pat. No. 3,811,141, issued May 21, 1974 to Stoeberl; U.S. Pat. No. 3,911,190, issued Oct. 7, 1975 to Myers et al.; U.S. Pat. No. 4,094,027, issued Jun. 13, 1978 to Vernon and U.S. Pat. No. 4,118,814, issued Oct. 10, 1978 to Holtom disclose double walled boat hulls, typically for multi-hull vessels, that include a buoyant material such as a gas or foam between the walls. U.S. Pat. No. 5,613,460, issued Mar. 25, 1997 to Stallard shows a submarine which has an outer skin which surrounds a foam. This foam is intended to provide buoyancy to compensate for external weapons launch systems.

U.S. Pat. No. 3,842,772, issued Oct. 22, 1974 to Lang teaches a vessel shaped to reduce the effect of large waves striking a platform. The semi-submerged ship has two elongated hulls which include a propeller at the stern thereof. U.S. Pat. No. 4,557,211, issued Dec. 10, 1985 to Schmidt, similarly has a pair of submerged hulls. The hulls provide a buoyancy support for the upper hull and have propellers at the sterns thereof. U.S. Pat. No. 5,313,906, issued Zapka discloses a SWAMH vessel per se. U.S. Pat. No. 5,184,561, issued Feb. 9, 1993 to Nickell, Jr. shows a vessel including finned planing pontoon hulls.

U.S. Pat. No. 3,338,203, issued Aug. 29, 1976 to Moore shows a watercraft hull fashioned of plural lighter than air gas filled compartments and U.S. Pat. No. 4,802,427, issued Feb. 7, 1989 to Biegel discloses a ship hull including sub-hulls that reduce pitch, roll and yaw. U.S. Pat. No. 5,178,085, issued Jan. 12, 1993 to Hsu teaches the wave cancellation properties of a multi-hull ship.

Propulsion systems have been the targets of improvements as in U.S. Pat. No. 4,838,819, issued Jun. 13, 1989 to Todorovic which discloses a marine propulsion unit including a ducted turbine having side inlets. U.S. Pat. No. 4,505,684, issued Mar. 19, 1985 to Holden et al. shows a thrust tube propulsion system including propellers disposed within the thrust tubes. U.S. Pat. No. 5,722,866, issued Mar. 3, 1998 to Brandt; U.S. Pat. No. 5,435,763, issued Jul. 25, 1995 to Pignata and U.S. Pat. No. 5,181,868, issued Jan. 26, 1993 to Gabriel relate to belt- and gear-driven turbines.

U.S. Pat. No. 2,941,495, issued Jun. 21, 1960 to Goldman shows a water craft propulsion system utilizing an impeller with spiral veins and a housing. U.S. Pat. No. 3,055,331, issued Sept. 25, 1962 to Singelmann teaches a centrifugal pump assembly driven with a turbine which is propelled by a jet engine. U.S. Pat. No. 5,722,864, issued Mar. 3, 1998 to Andiarena shows a marine propulsion system which includes a rotational unit having blades rigidly secured to the inner periphery of the rotational unit.

Despite the teachings of the prior art, a need still exists for a multihull vessel which is stable, maneuverable and sturdy and which can efficiently accommodate an active propulsive means which optimizes the passage of the vessel through the water.

SUMMARY OF THE INVENTION

Accordingly, it is an object of the present invention to provide a vessel having an upper hull platform, at least two submerged hulls which are filled with a buoyant core material and joined to the upper hull platform by support struts.

It is another object of the present invention to provide a multihull vessel having an upper hull platform having at least one easily accessible engine situated thereon, at least two submerged hulls which are filled with a buoyant core material and which are joined to the upper hull platform by support struts, each of the submerged hulls housing a rotary propulsive means which is powered by the at least one engine through a work translating means.

It is an additional object of the present invention to provide a multihull vessel wherein the entire body of each submerged hull has utility in being a housing for a rotary propulsive means and aids in the channeling of water therethrough to increase the efficient propulsion of the vessel.

It is a further object of the present invention to provide a multihull vessel wherein the fore end and the aft end of each submerged hull is angled in order to enhance the wave piercing capabilities of the multihull vessel.

It is yet another object of the present invention to provide a multihull vessel wherein each submerged hull has a prismatic-shaped outer hull in order to enhance its stealth properties.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein.

DETAILED DESCRIPTION

Figure 1:
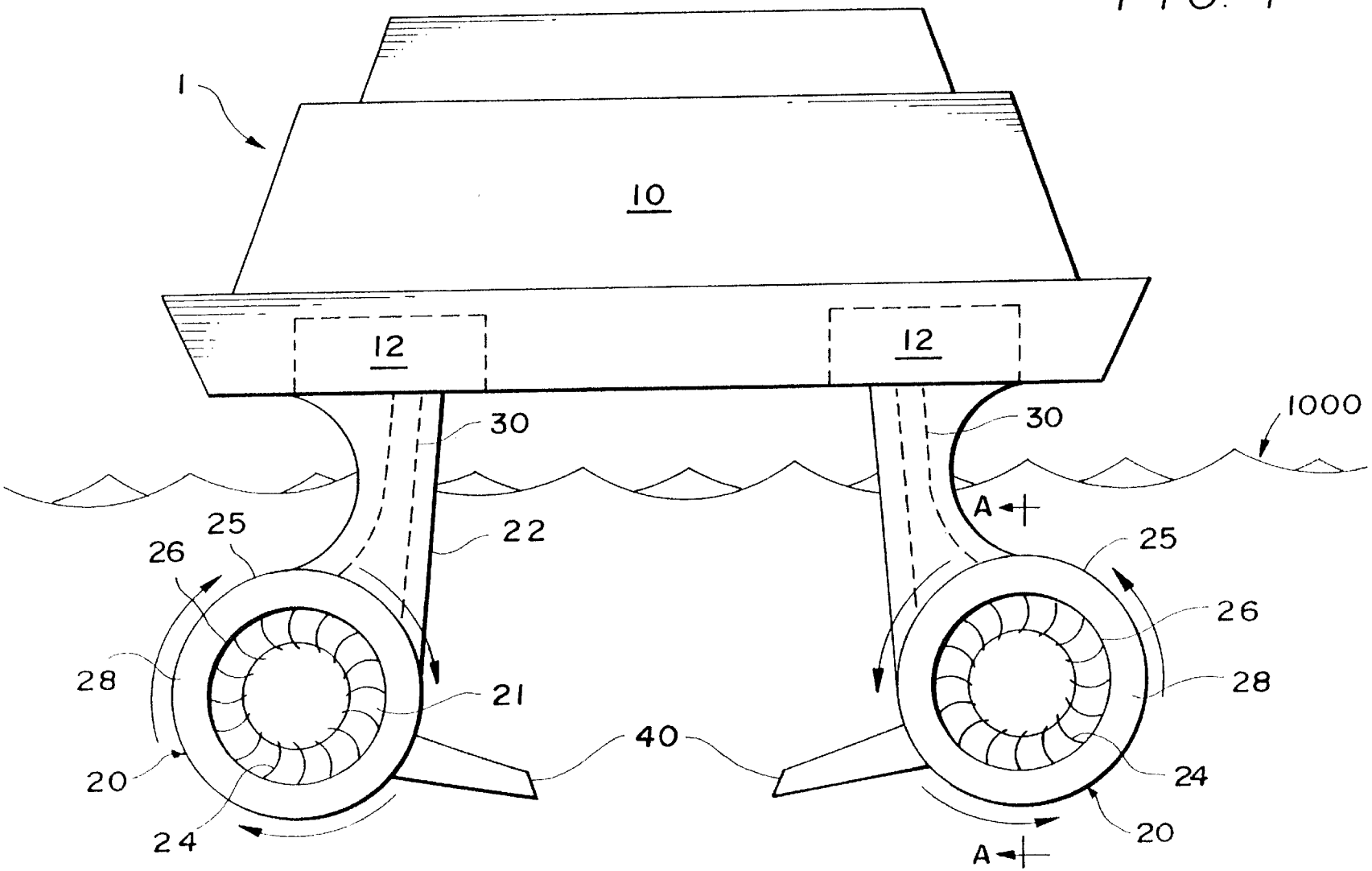
FIG. 1 is an environmental rear view of a multihull vessel of the instant invention situated it water.
Figure 2:
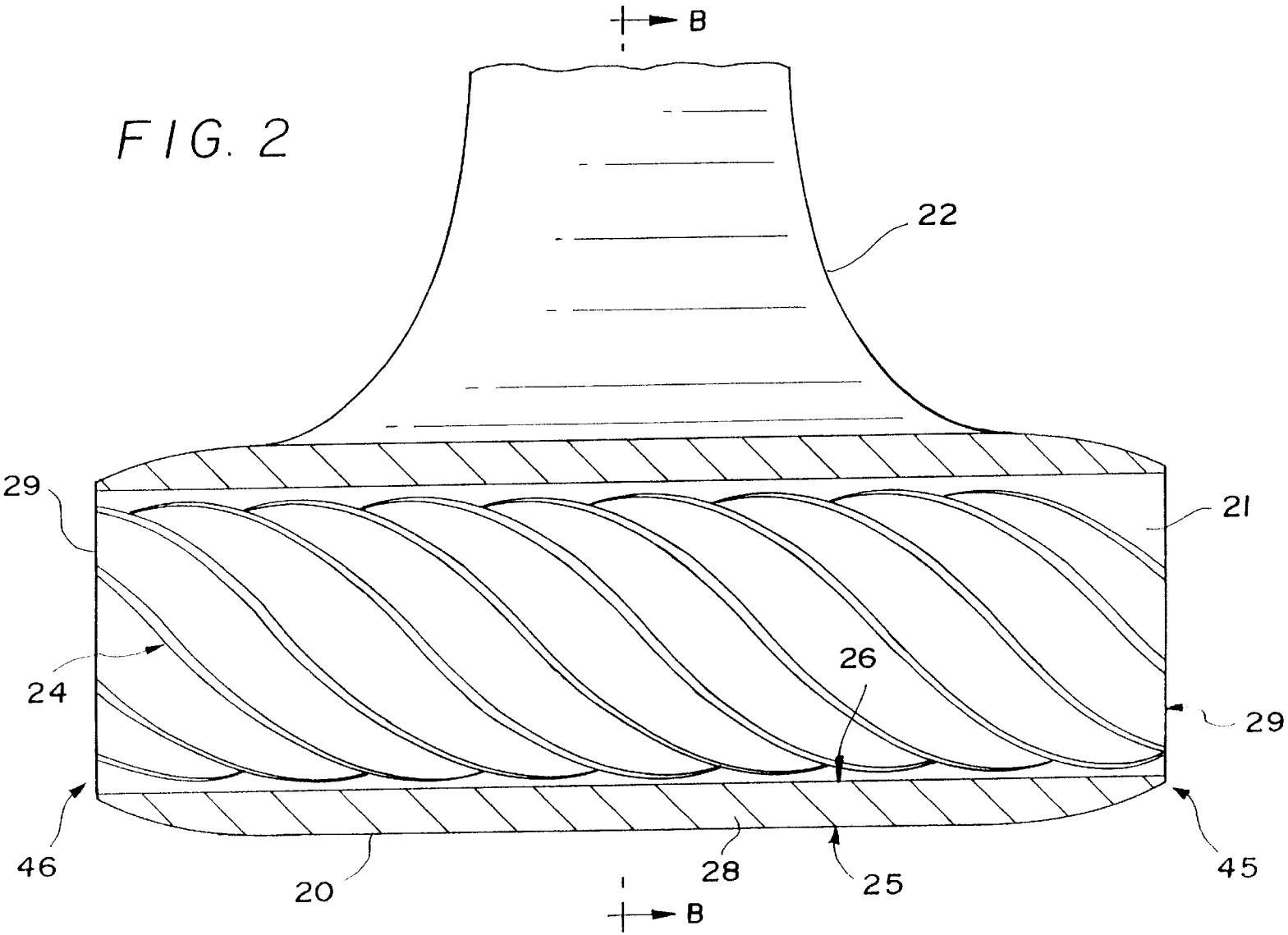
FIG. 2 is an axial cross sectional view of a submerged hull and supporting strut of the instant invention as shown in FIG. 1 and taken along line A—A (not to scale).

As shown in FIGS. 1 and 2, the multihull vessel 1 of the instant invention comprises an upper hull platform or surface hull 10 which in use may be situated above the design water line of the vessel and at some height above a body of water 1000, at least two submerged hulls 20 each capable of housing therein a rotary propulsive means 24 and each respectively being fixedly connected to the surface hull 10 by a supporting strut 22. At least one engine 12 may be provided on the surface hull and may comprise any sort of engine, e.g. internal combustion, electric, brushless DC, linear magnetohydrodynamic and the like. The at least one engine 12 is provided to drive the rotary propulsive means 24 when present and is connected to the rotary propulsive means by a work translating means 30 shown in broken line, the work translating means being capable of converting the work done by the engine into a motivating force for rotating the rotary propulsive means 24 housed within a cylindrical passage 21 of the submerged hulls 20 to move the vessel 1. Situating of the at least one engine 12 on the surface hull 10 permits easy access by a user for repairs and eliminates the need to provide housing for it within the submerged hulls 20.

The multihull vessel construction includes both powered craft, such as and unpowered craft, including for example, a sail boat, a row boat or a barge which is towed by a second vessel, wherein the submerged hulls finction solely in providing buoyancy to the unpowered vessel.

As will be appreciated by a practitioner in the art of multihull vessels, the geometric configuration of the supporting struts 22 and the positioning of the submerged hulls 20 may be selected to suit the specific characteristics of a desired vessel such that performance features which are susceptible to optimization by such selection are in fact optimized. It is recognized that previous inventions have addressed the extent to which such optimizations by their nature occur independently from the teachings of the instant invention. In particular, the teachings of U.S. Pat. No. 4,802,427 to Biegel, which indicates the importance of carefully positioning submerged hulls relative to the surface hull in order to dampen roll and yaw movements, are noted and incorporated herein by reference as are the strut arrangements taught in U.S. Pat. No. 5,313,906 to Zapka. It should be further appreciated that the submerged hulls may comprise a single, or main, submerged hull which may be stabilized by ancillary submerged hulls or pontoons.

Looking now to FIGS. 1 and 2, the submerged hulls 20 comprise an outer wall 25 and an inner wall 26 separated by and containing a buoyant core material 28 and surrounding a cylindrical passage 21. Preferred materials for the outer and inner walls 25, 26 are hardened plastics, fibreglass and composite materials which demonstrate resistance to degradation brought on by the continual contact of water sources. It is appreciated that a "topskin" of some useful material, such as a polymeric woven, nonwoven or reinforced web, may be applied to all or to a portion of the surface of the hulls in order to enhance characteristics including providing decorative or informative indicia, increasing degradation resistance, stiffening the hulls with respect to bending forces and decreasing surface friction. Alternatively, the surfaces of the outer and inner walls 25, 26 may be directly modified by chemical or mechanical means to effect these goals. The buoyant core material 28 is preferably a gas, especially a gas which is less dense than air such as hydrogen or helium, or a foamed polymer material entraining a gas within the foam structure. Moreover, where hydrogen or helium serve as buoyant materials, the outer and inner walls 25,26 may require barrier liners to prevent seepage of the gas. The volume of buoyant core material 28 contained between the outer and inner walls 25, 26 may be provided through direct calculative means to cause a displacement and concomitant buoyancy which is required by a particular vessel. For example, a thinner hull may be desirable where an increase in travel speed of the vessel is the primary goal, whereas different configuration/thickness of the hull may required to provide greater vessel payloads. Struts 22 may be constructed from stiff, durable material such as corrosion resistant alloys, plastics, fibreglass and the like. Construction methods may require the separate manufacture of the submerged hulls 20 and struts 22 which are thereafter joined to one another by suitable means such as welding, bonding, joining by screws and the like. Similarly, the struts are attached to the surface hull 10 by permanent joining means. Altematively, the struts 22 may be formed integrally with both or either of said surface hull 10 and submerged hulls 20.

The submerged hulls 20 may be cylindrical in form as shown for example in FIG. 1, each hull surrounding a cylindrical passage 21 with the inner walls 26 being open to the passage of water at ends 29 at either a fore 45 or aft 46 portion of the hull. The practitioner may apply hydrodynamic principles to the surface topology of the hulls and rotary propulsive means to produce performance-improving configurations, variants of which will be discussed in alternative embodiments of the present invention.

Figure 2A:
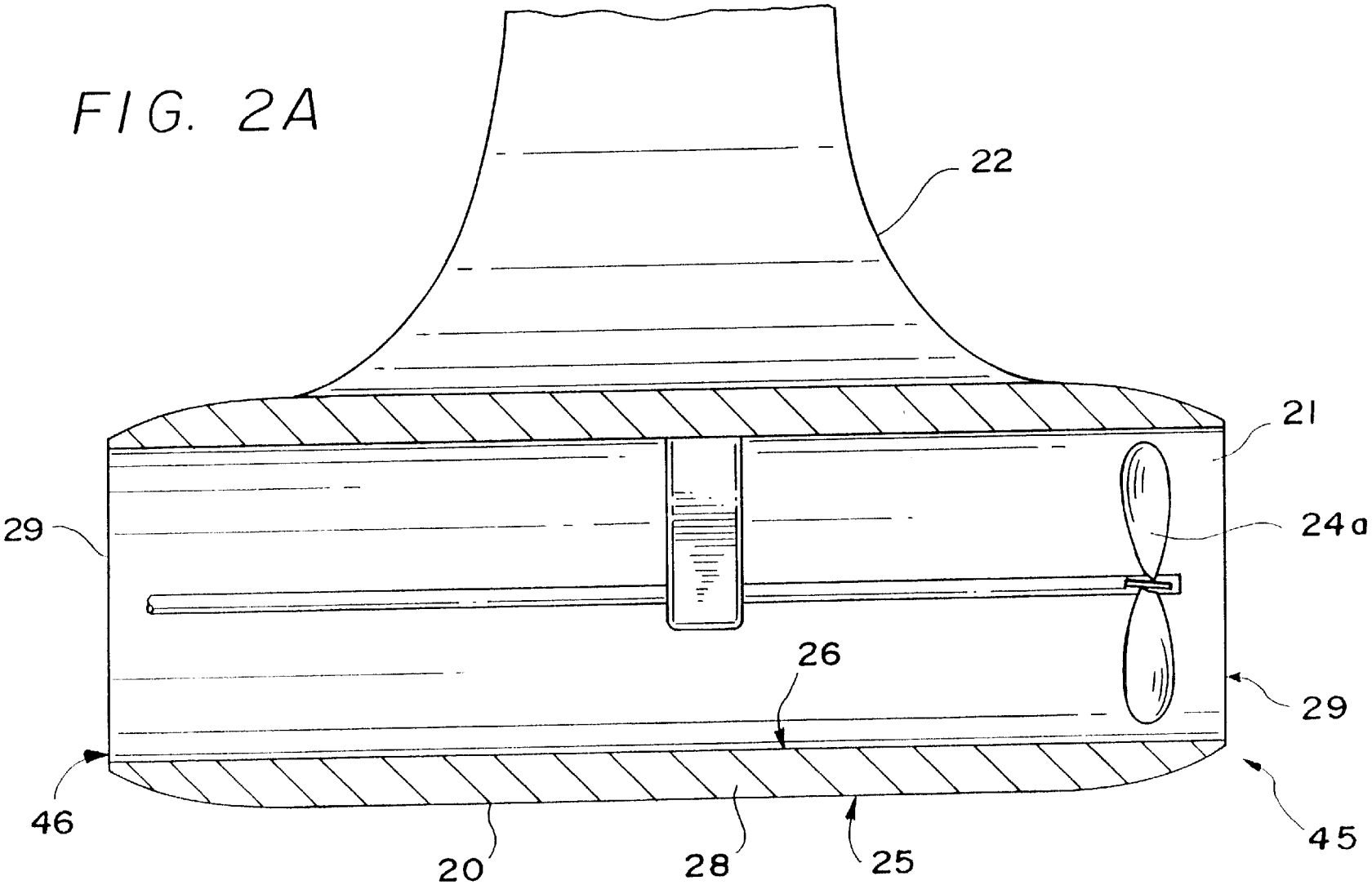
FIG. 2A is an axial cross sectional view of a submerged hull and supporting strut of the instant invention as shown in FIG. 1 and taken along line A—A, showing an alternative embodiment using a propeller.

When the multihull vessel is a powered craft, a rotary propulsive means 24 is housed and is rotatably secured within each of the submerged hulls 20. The rotary propulsive means 24 may be in the form of a plurality of blades, a plurality of fins, a helical screw extending the length of the hull, or a propeller 24*a*, as shown in FIG. 2A. Turning of the rotary propulsive means 24 in either rotary direction can effect either a forward or a backward draw to cause movement of the vessel. Because the engine(s) are situated on the upper hull platform and not housed within the submerged hulls, the entire cylindrical spaces encompassed by the submerged hulls 20 are available to house propelling means, viz. the rotary propulsive means 24. Consequently, efficient use of the volume occupied by the submerged hulls 20 is achieved. Moreover, the relative efficiency of a plurality of blades or fins or a helical screw over that of simple propellers such as that shown in U.S. Pat. No. 5,313,906 to Zapka, provides the multihull vessel of the present invention with an advantageous propulsion means. The entire body of the submerged hulls 20 function to channel water through the cylindrical space 21 containing the rotary propulsive means 24 so that the rotary motion of a helical screw or propeller is translated into a thrust guided in one primary direction by the submerged hull. In contrast, the rotation of the propellers shown by Zapka directs the flow of water not only in a desired thrusting direction, but also in movement directed outwardly from the plane of rotation along lines which are perpendicular to the desired direction of thrust.

Figure 4:
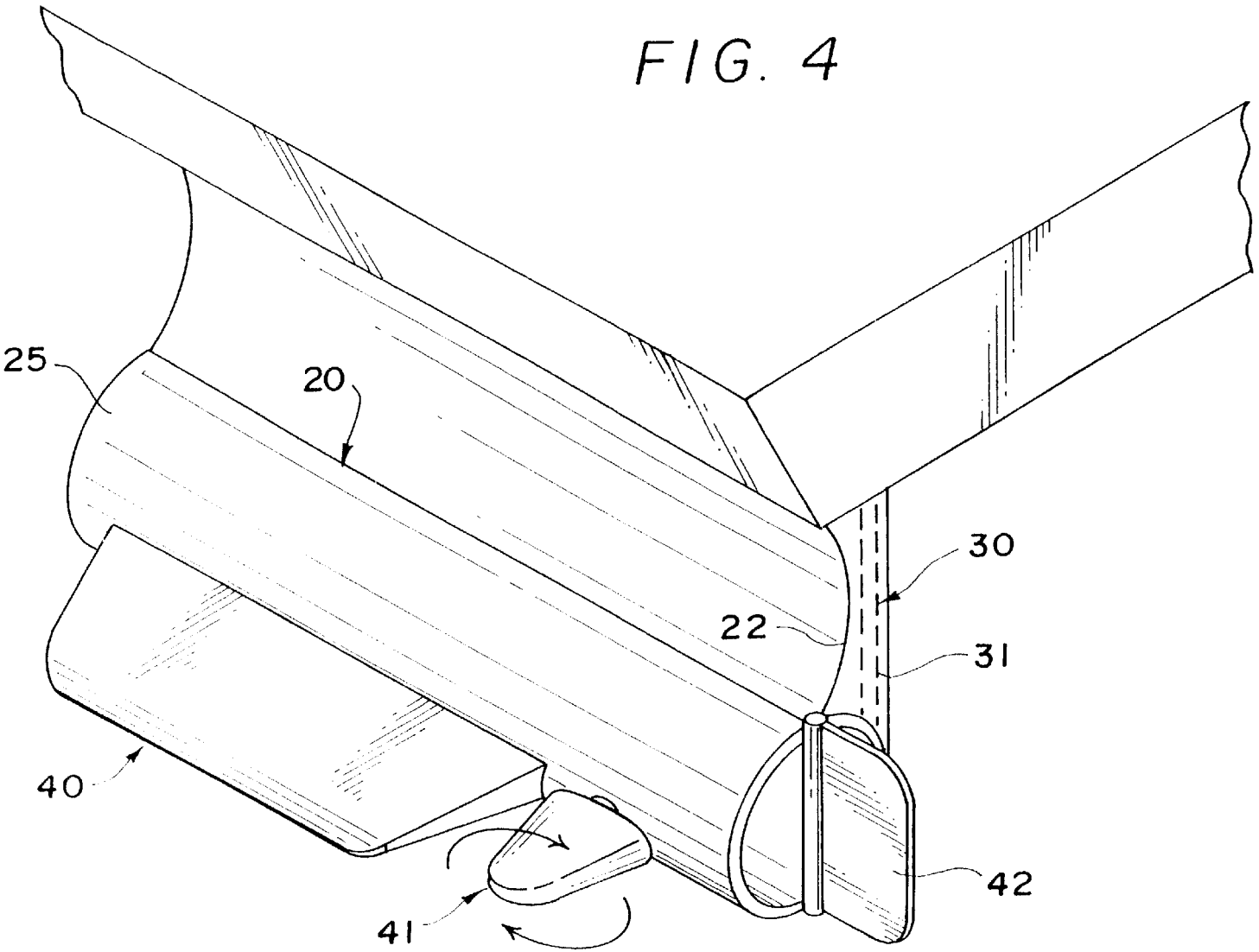
FIG. 4 is a rear-side perspective view of a submerged hull of the instant invention.

Looking now at FIG. 4, fins 40 may be mounted to the outer walls 25 of the submerged hulls 20 to provide stabilization and lift to the moving vessel. Moreover, the submerged hulls may be provided with a pivotably secured fin 41, the pivoting of which can create lift to effect turning of the vessel. As a further steering aid, rudders 42 may be pivotably mounted to the aft end 46 of the submerged hulls 20.

Figure 3:
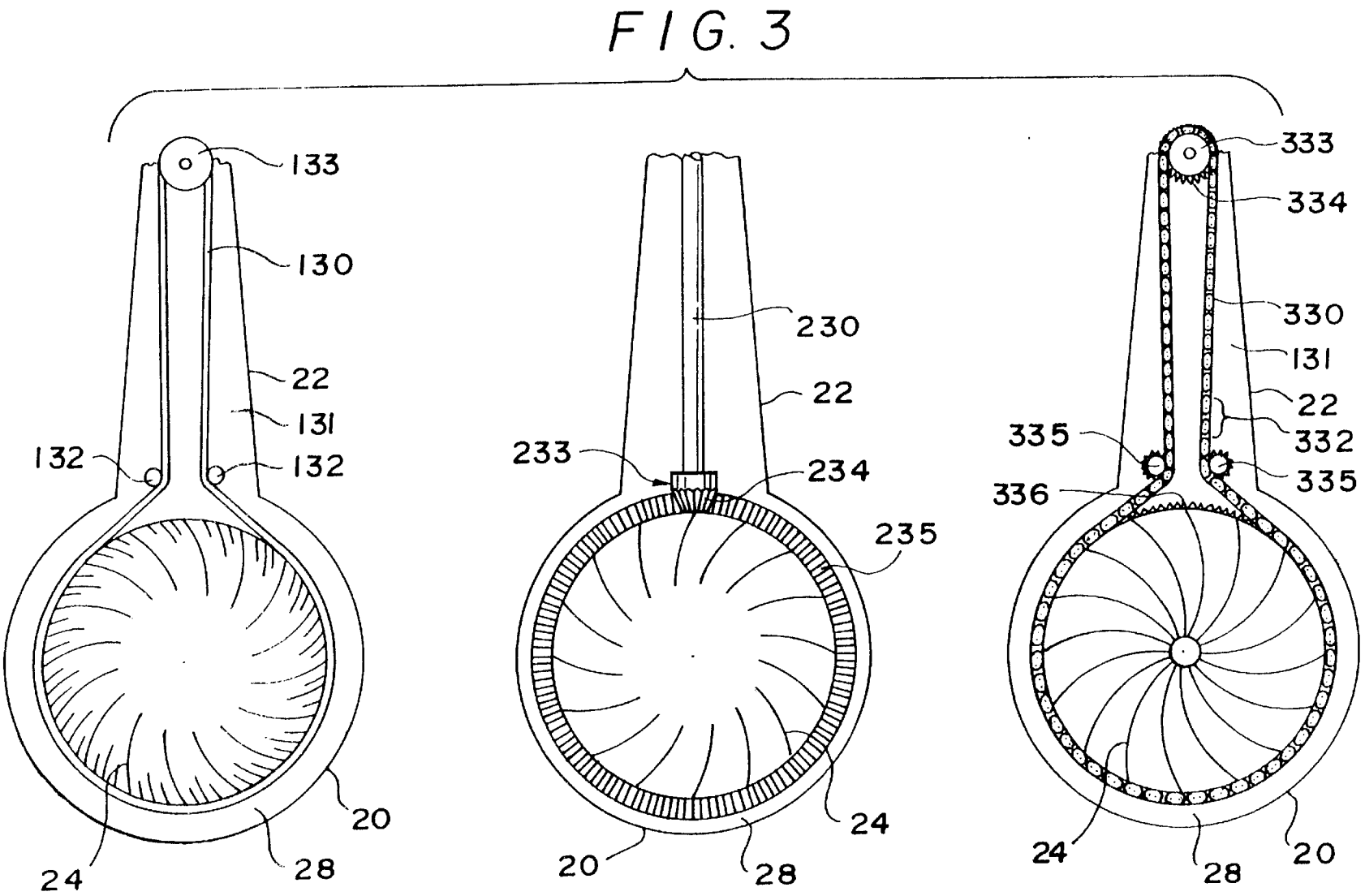
FIG. 3 is a cross sectional view of the rotary propulsive means shown in FIG. 2 and taken along line B—B illustrating three embodiments of a work translating means to cause rotation of said rotary propulsive means (not to scale).

As shown in FIG. 1 and 3, the at least one engine 12 may be connected to the rotary propulsive means 24 through the struts 22 by a work translating means 30 which may constitute a drive having a belt 130 a geared drive shaft 230 or a chain 330 all of which are well-known mechanisms for work translating the work of an engine into rotary movement. It is required, therefore, that the struts 22 have a hollowed section 31 through which a respective belt 130, drive shaft 230 or chain 330 may be housed and permitted movement. The belt drive may be moved by frictional contact with an engine-driven roller 133, such movement being directed to the rotary propulsive means 24 which is also rotated by frictional contact with the belt 130. The belt 130 may be secured in its movement path by the use of guide rollers 132 which guide the belt and prevent slippage thereof. The chain 330 articulates a translation similar to that of the belt 130, having numerous connected links 332 which may be engaged by individual cogs 334 of an engine-driven cogwheel 333. Ancillary cogwheels 335 secure the chain in a manner analogous to that of the guide rollers. The rotary propulsive means 24 is provided with cogs 336 which also engage the links 332 of the chain 330; thus, the propulsive means itself is a cogwheel. A drive shaft 230 rotated by the engine 12 may have a cogwheel 233 through which motion is transmitted to the rotary propulsive means 24 through cogs 236 provided thereon.

Figure 5:
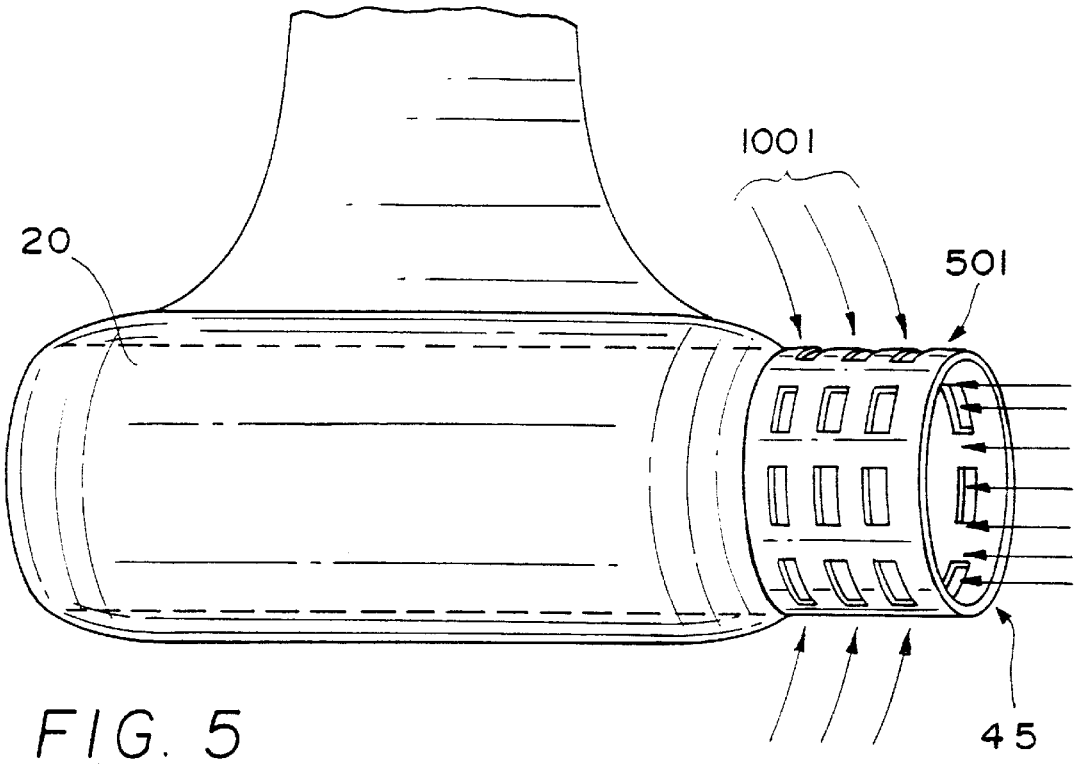
FIG. 5 is a side perspective view of an alternative embodiment of a submerged hull of the instant invention, having a slotted fore end.
Figure 6:
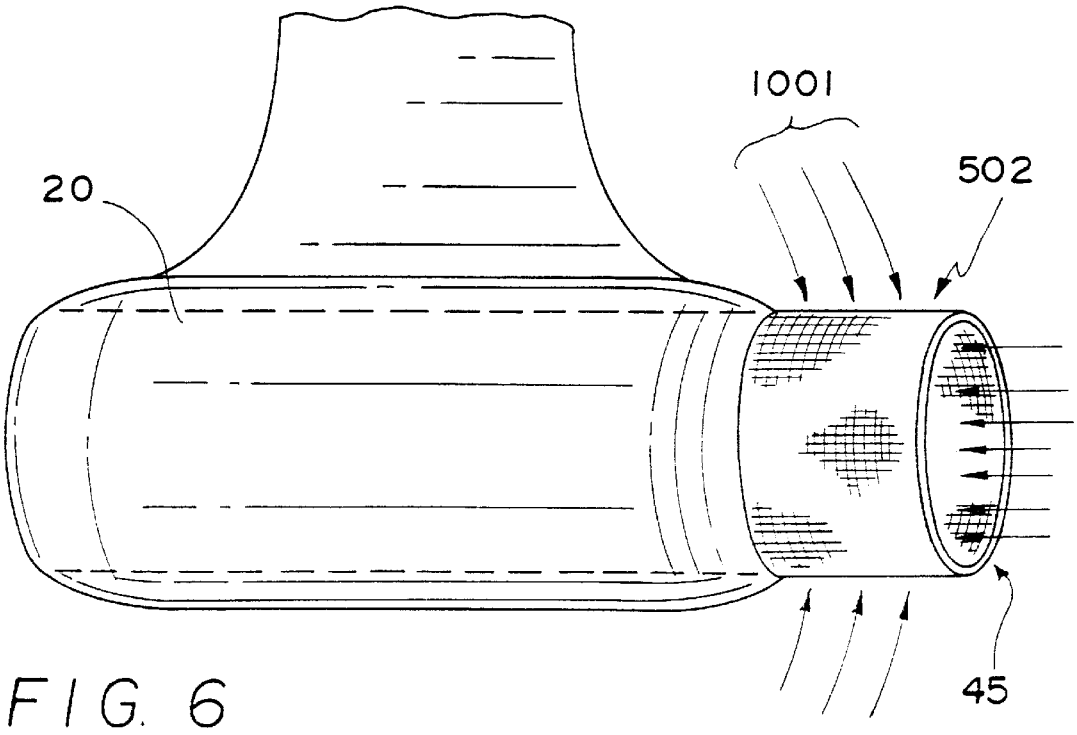
FIG. 6 is a side perspective view of another alternative embodiment of a submerged hull of the instant invention having a screened fore end.

As shown in FIGS. 5 and 6, the fore end 45 of the submerged hulls 20 may be provided with slots 501 or comprise a screen front 502 for an increased draw of crosscurrent waters 1001 through the rotary propulsive means.

Figure 7:
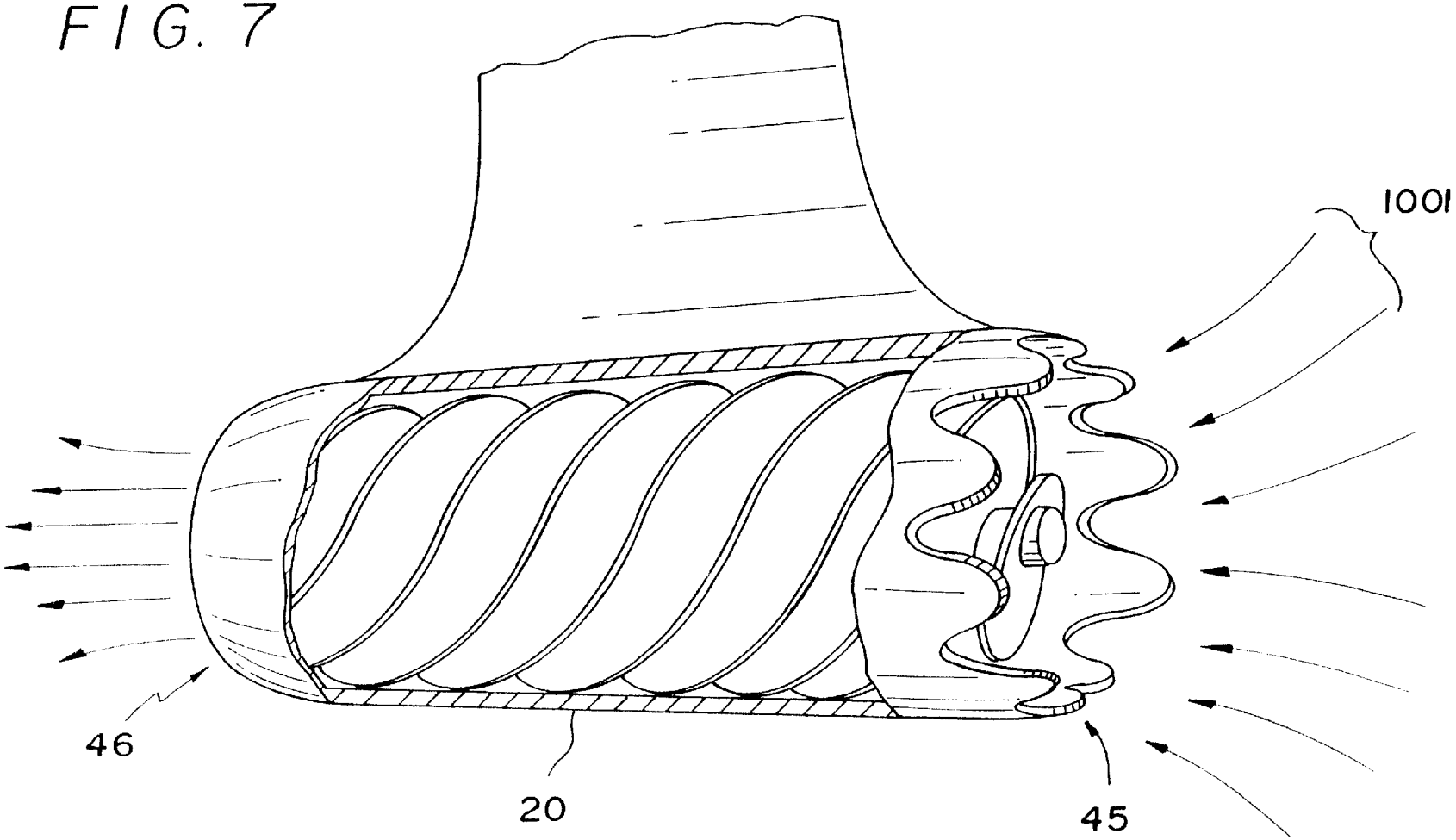
FIG. 7 is a side perspective view of another alternative embodiment of a submerged hull of the instant invention.

FIG. 7 illustrates a modified submerged hull 20 having a tapered profile gradually diminishing in diameter from the fore end 45 to the aft end 46 which has the general effect of boosting the thrust of the rotary propulsive means 24. As shown, the submerged hull has a scalloped front at the fore end 45 to provide an increased draw of cross currents 1001 as with the preceding two embodiments. The contour of the tapered submerged hull may be incorporated into all of the previously-described embodiments without specifically requiring the scalloped front at the fore end. The practitioner may optimize the performance of the tapered submerged hull for a specific vessel through direct experimentation or through calculative methods.

Figure 8A:
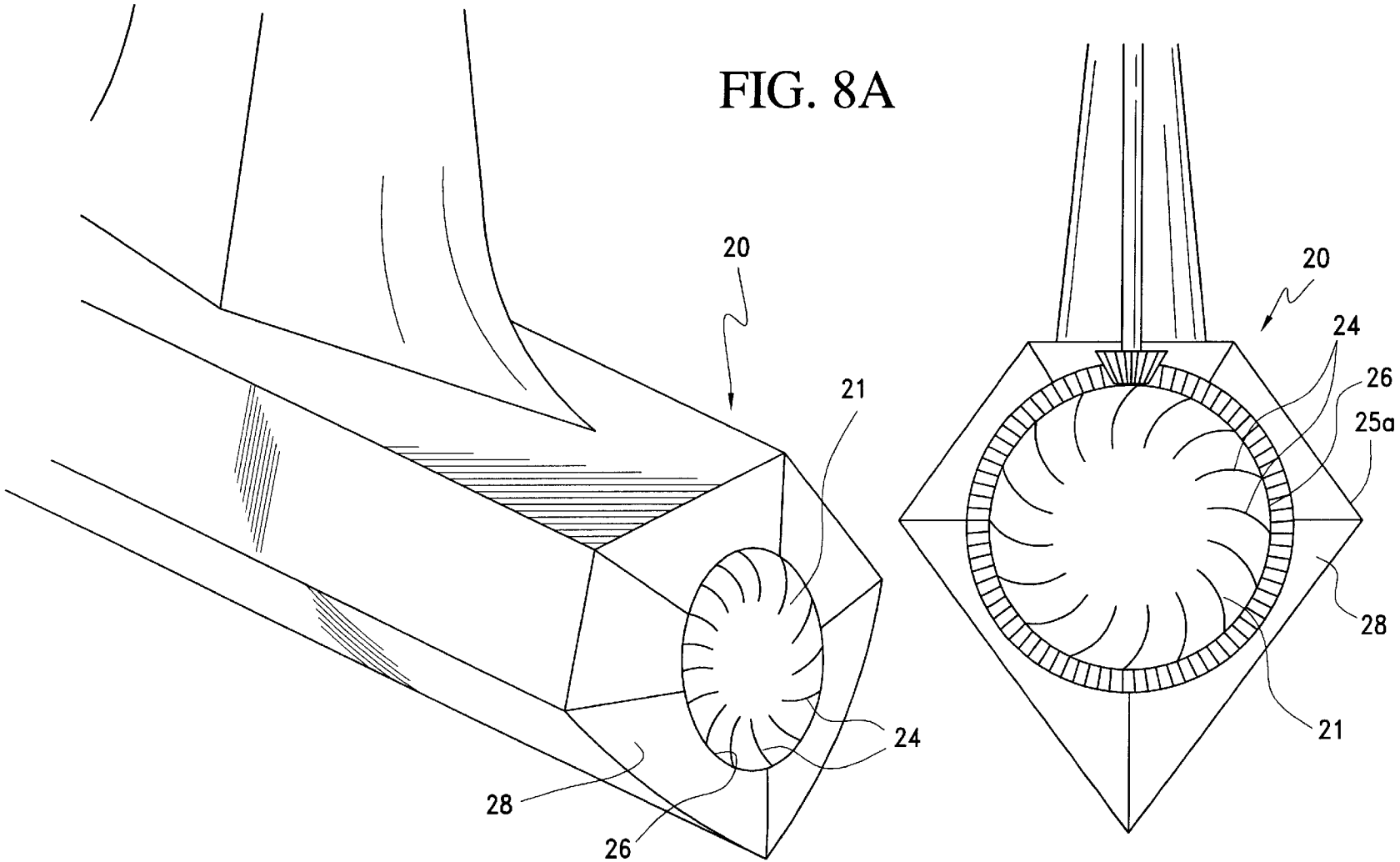
FIG. 8A is a end view of another alternative embodiment of the submerged hull of the instant invention having a prismatic shaped outer hull.

FIG. 8A illustrates a modified submerged hull having a prismatic shaped outer wall 25*a*. The utilization of a prismatic shaped outer wall enhances the stealth properties of the multihull vessel due to the fact that the prismatic outer wall is more difficult to detect by radar.

Figure 8B:
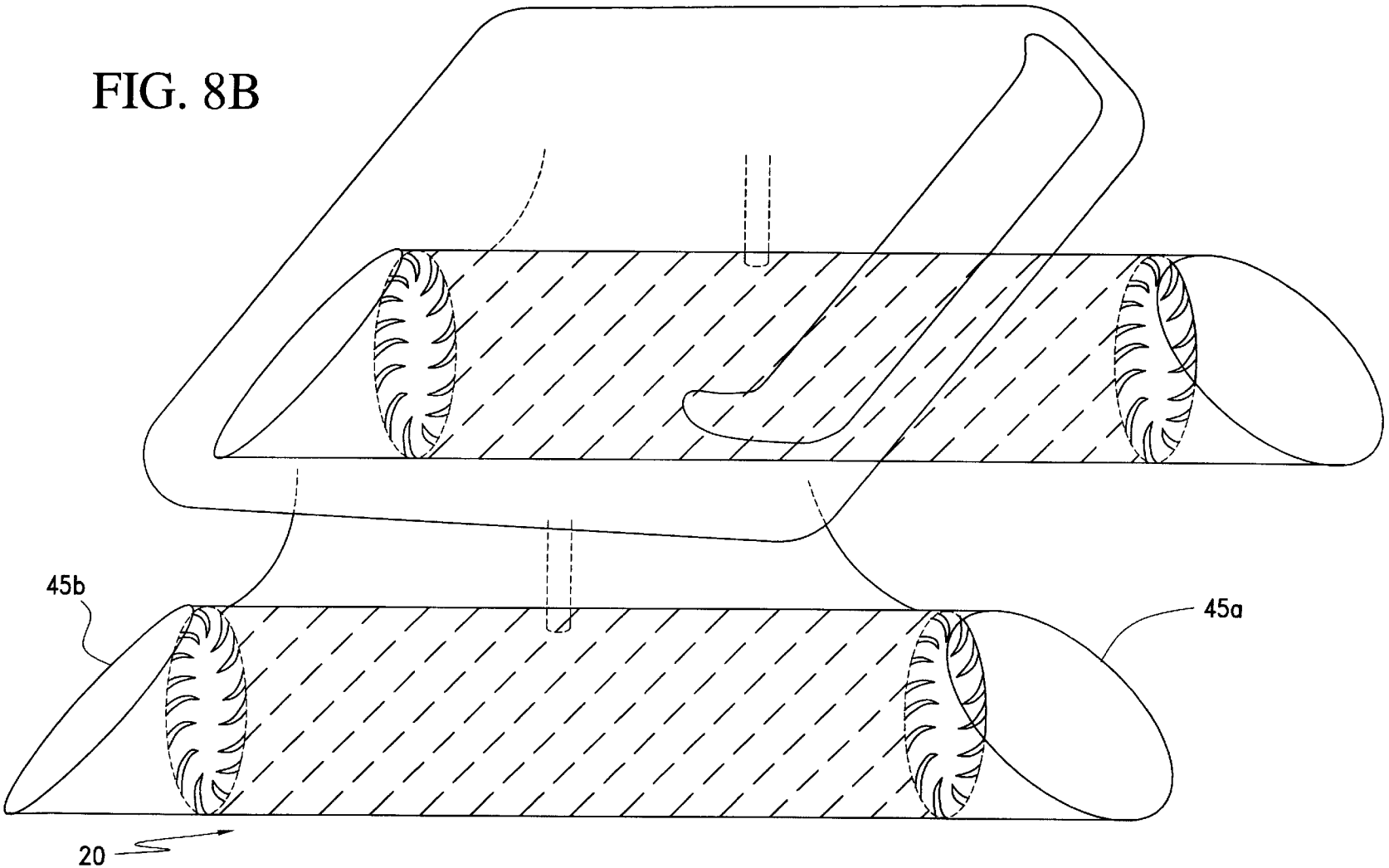
FIG. 8B is a side view of another alternative embodiment of one end the submerged hull of the instant invention having an angled end.

FIG. 8B illustrates a modified submerged hull wherein at least one end, and preferably both the fore end 45*a* and the aft end 46*a* are provided with angled end. The degree of angle will be dependent upon the desired performance characteristics of the multihull vessel. Preferably, the angled end is a 45° angled end. The use of an angled end augments the performance of the vessel by enhancing the wave piercing capabilities of the vessel. In addition, the angled end(s) can function as a kind of temporary anchor when the vessel is run onto a sandy beach.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A motorized multihull vessel comprising:

an upper hull platform;

at least one engine capable of producing work, said engine being situated on said upper hull platform;

at least two supporting struts, each of said supporting struts having a hollowed section;

at least two submerged hulls, each of said submerged hulls being fixedly joined to said upper hull platform by a respective one of said supporting struts, each of said submerged hulls comprising an outer wall having a prismatic shape, an inner wall, a buoyant core material disposed between said inner wall and said outer wall, a fore end and an aft end, said inner wall having an inner surface defining a cylindrical space;

a rotary propulsive means, said rotary propulsive means being housed within said cylindrical space of each of said submerged hulls; and a work translating means, said work translating means joining said engine to said rotary propulsive means, whereby work produced by said engine is translated by said work translating means into rotary movement of said rotary propulsive means.

2. The multihull vessel in accordance with claim 1, wherein said rotary propulsive means is selected from the group consisting of a plurality of blades, a helical screw or at least one propeller.

3. The multihull vessel in accordance with claim 1, wherein each of said submerged hulls further comprises a pivotable rudder pivotably affixed to its said aft end.

4. The multihull vessel in accordance with claim 1, wherein each of said submerged hulls further comprise a stabilizing fin rigidly affixed to said outer wall and a pivotable fin pivotably attached to said outer wall.

5. The multihull vessel in accordance with claim 4, wherein each of said submerged hulls further comprises a pivotable rudder pivotably affixed to its said aft end.

6. The multihull vessel in accordance with claim 1, wherein said fore end of each of said submerged hulls is provided with a plurality of slots.

7. A motorized multihull vessel comprising:

an upper hull platform;

at least one engine capable of producing work, said engine being situated on said upper hull platform;

at least two supporting struts, each of said supporting struts having a hollowed section;

at least two submerged hull, each of said submerged hulls being fixedly joined to said upper hull platform by a respective one of said supporting struts, each of said submerged hulls comprising an outer wall, an inner wall, a buoyant core material disposed between said inner wall and said outer wall, a fore end having an angled end and an aft end, said inner wall having an inner surface defining a cylindrical space;

a rotary propulsive means, said rotary propulsive means being housed within said cylindrical space of each of said submerged hulls; and a work translating means, said work translating means joining said engine to said rotary propulsive means, whereby work produced by said engine is translated by said work translating means into rotary movement of said rotary propulsive means.

8. The multihull vessel in accordance with claim 7, wherein said rotary propulsive means is selected from the group consisting of a plurality of blades, a helical screw or at least one propeller.

9. The multihull vessel in accordance with claim 7, wherein each of said submerged hulls further comprises a pivotable rudder pivotably affixed to its said aft end.

10. The multihull vessel in accordance with claim 7, wherein each of said submerged hulls further comprise a stabilizing fin rigidly affix to said outer wall and a pivotable fin pivotably attached to said outer wall.

11. The multihull vessel in accordance with claim 10, wherein each of said submerged hulls further comprises a pivotable rudder pivotably affixed to its said aft end.

12. The multihull vessel in accordance with claim 7, wherein said fore end of each of said submerged hulls is provided with a scalloped front.

13. The multihull vessel in accordance with claim 7, wherein said aft end of each submerged hull is an angled end.

14. The multihull vessel in accordance with claim 13, wherein said fore end is angled at a 45° angle.

15. The multihull vessel in accordance with claim 7, wherein said fore end is angled at a 45° angle.

* * * * *